United States Patent [19]

Mahoney

[11] Patent Number: 4,749,351

[45] Date of Patent: Jun. 7, 1988

[54] LIGHTER

[75] Inventor: Frederick G. Mahoney, Pittsburgh, Pa.

[73] Assignee: FGM Enterprises, Inc., Detroit, Mich.

[21] Appl. No.: 41,440

[22] Filed: Apr. 23, 1987

Related U.S. Application Data

[63] Continuation-in-part of Ser. No. 880,576, Jun. 30, 1986, abandoned.

[51] Int. Cl.[4] ..... F23D 2/00

[52] U.S. Cl. ..... 431/252; 431/143

[58] Field of Search ..... 431/252, 129, 143; 131/329, 234, 249

[56] References Cited

U.S. PATENT DOCUMENTS

| | | | |
|---|---|---|---|
| 1,015,876 | 1/1912 | Dubsky | 431/143 X |
| 2,432,265 | 12/1947 | Ward, Jr. | 431/252 X |
| 2,677,948 | 5/1954 | Gehrie | 431/143 |
| 2,978,889 | 4/1961 | Atchley | 431/252 X |
| 2,979,930 | 4/1961 | Ichikawa | 431/252 X |

*Primary Examiner*—Larry Jones

*Attorney, Agent, or Firm*—Carothers & Carothers

[57] ABSTRACT

A hand-held smoker's lighter having a flame shield that defines a transverse opening in which a venturi effect increases the velocity of air flow to draw the lighter flame deep into a smoking pipe bowl for pipe lighting and a top opening through which the lighter flame projects for cigarette and cigar lighting, and further incorporating a novel inner body structure that is interfitted within a casing and includes novel flint retention and storage structure, and a novel spring bias structure which cooperates with the casing to provide enhanced positive closure of a hinged lid portion of the case.

21 Claims, 3 Drawing Sheets

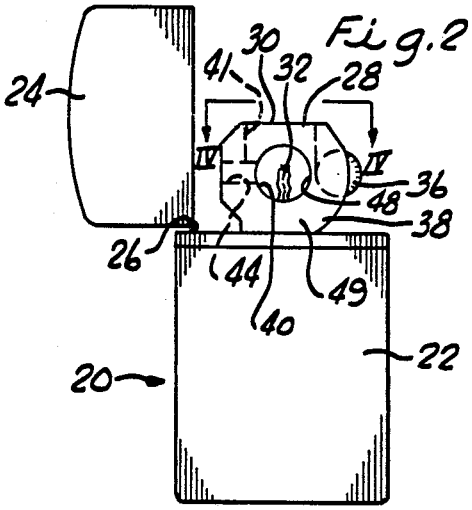
Fig. 2
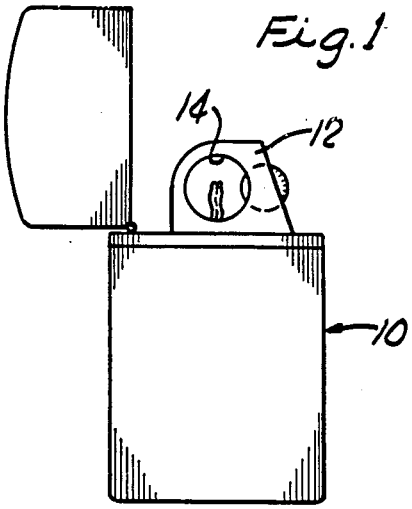
Fig. 1
PRIOR ART
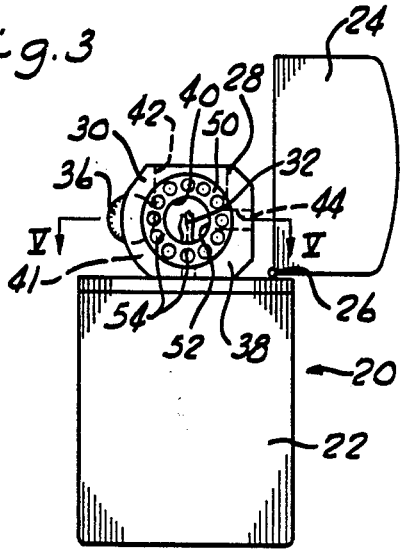
Fig. 3
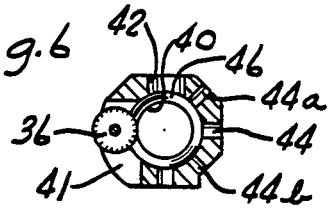
Fig. 6
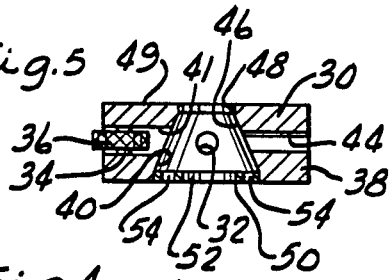
Fig. 5
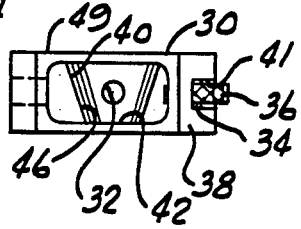
Fig. 4
Fig. 7
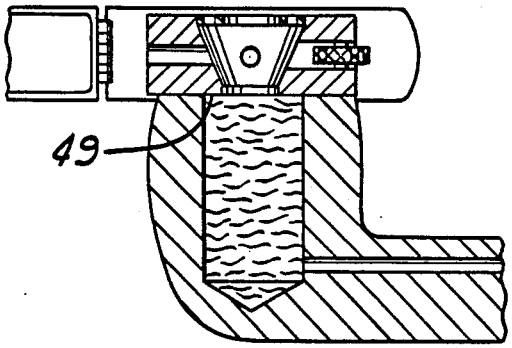

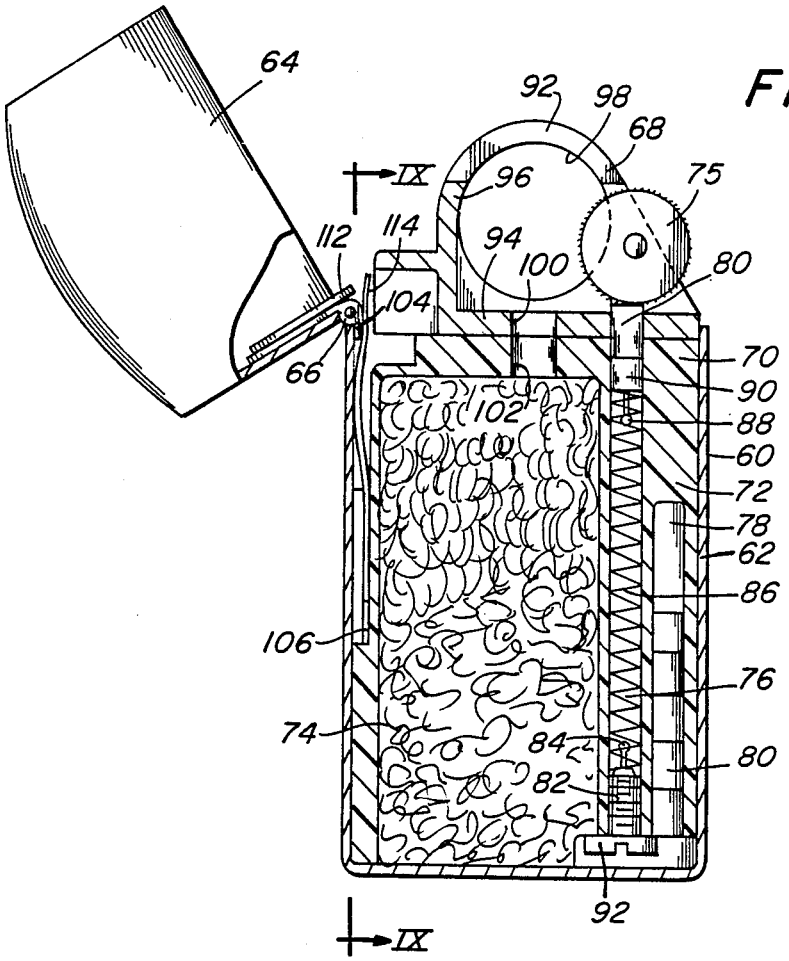
FIG. 8
FIG. 9
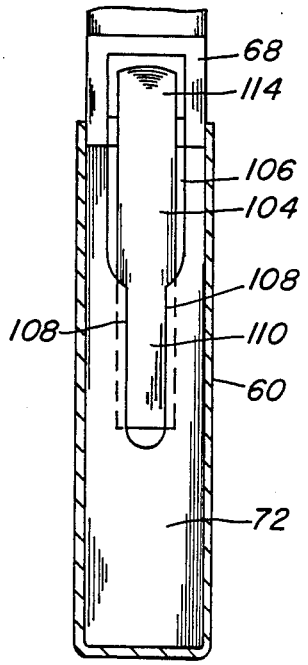
FIG. 10
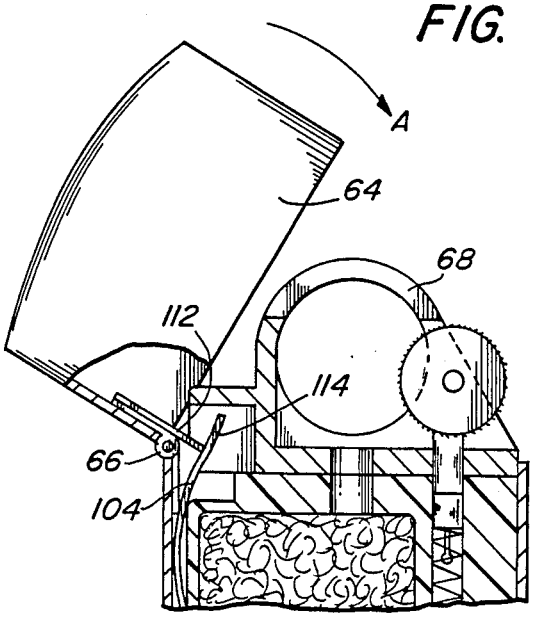

LIGHTER

This is a continuation-in-part of application Ser. No. 880,576, filed June 30, 1986, now abandoned.

In the art of lighters for the lighting of cigars and cigarettes it is well known to provide an apparatus comprising a body with a hinged cap that covers a wick and a flame shield. Typically, the wick draws combustible lighter fluid from a reservoir in the lighter body by capillary action. When a spark is stuck near the wick, a mixture of air and fluid vapors is ignited to provide a flame for lighting a cigar or cigarette. Similar lighters for lighting a smoking pipe are also known.

The flame shield of a conventional cigarette ligher typically comprises a formed, perforated metal body which surronds the wick and has an open top from which the lighter flame projects upwardly. This sort of flame shield configuration is not well suited for pipe lighting, which requires the flame to be drawn downwardly into the pipe bowl. Conventional pipe lighters, such as disclosed in U.S. Pat. No. 2,432,265, commonly have included a chimney defined by a transverse through opening. The user lights the pipe by drawing air via the pipe stem and bowl through the chimney to thereby draw the lighter flame down into the pipe bowl.

Such conventional pipe lighters have been subject to certain undesirable limitations. For example, even with their intended downdraft capability, prior art pipe lighters do not allow the flame to be drawn with ease to a sufficient depth within the pipe bowl to ignite an appreciable quantity of tobacco therein. The tobacco therefore often will not spontaneously sustain combustion and must be relighted repeatedly. Often the only alternative available to the pipe smoker is to draw heavily on the pipe at initial lighting to spread the tobacco combustion within the pipe bowl. This can result initially in a very hot and biting concentrated smoke which dulls the sensory capacity of the user and deprives him of the cooler, mellow smoking experience he desires. Among other shortcomings of known pipe lighters is that many are not well suited for cigarette lighting and may be subject to easy flame blowout in windy conditions. Still another shortcoming of prior lighters, particularly those with hinged lids, is that the lid closing mechanism often loosens markedly with use until the lid is no longer held firmly closed thereby. Some prior lighters also have been subject to a tendency for the lighter assembly to lift from the lighter case in response to opening and closing of the lid. This occurs as a rsult of the forces exerted by the lid closing mechanism during lid opening and closing, as the lid closing mechanism commonly has been carried by the lighter assembly which resides in the lighter case and is selectively removable therefrom for changing the flint or replenishing the fluid supply.

The present invention contemplates a novel and improved lighter which is well suited for both cigarette and pipe lighting. The lighter of this invention incorporates a novel flame shield structure which permits easy and efficient cigarette lighting when in an upright or sideways position, and superior pipe lighting as well. The invention additionally provides reduced incidence of flame blowout.

Another aspect of the invention includes a novel inner lighter assembly which carries the lighter flame shield and is interfitted within a casing having a hinged lid. The inner assembly incorporates novel flint retention and storage structure, preferably in the form of a pair of parallel bores extending from the lower end of a body member which forms the fluid reservior and supports the lighter components thereon. One of the parallel bores serves as a flint storage barrel and the other retains a flint in biased contact with the friction wheel. A screw is received into a threaded lower end portion of one of the parallel bores, and an enlarged head portion of the screw or a cooperating washer, overlaps the open end of the other of the parallel bores to close same. An alternative flint retention structure is also disclosed.

In a further aspect of the invention, a leaf spring is affixed to the inner body member to cooperate with a tab that is affixed to the hinged lid of the lighter casing to thereby provide a positive closure mechanism in the nature of a biased, over-center snap action mechanism. The novel lid closure structure avoids the problem of the tendency above described for the inner assembly of the lighter to lift from the casing in response to lid opening and closing. Furthermore, the spring and tab lid closure structure maintains its mechanical integrity, precision of fit and positive closure after extended use of the lighter. The lighter lid thereof does not loosen and when closed is firmly biased into the closed position even after the hinge and the closure mechanism have sustained many years of regular use and significant wear.

Accordingly, it is one general object of this invention to provide an improved pipe lighter.

Another object of the invention is to provide a dual function lighter which is well suited to both cigarette and pipe lighting.

A more specific object of the invention is to provide a lighter which offers enhanced flame blowout protection and superior downdraft chimney air flow to permit easy smoking pipe light-up without undesirable heavy drawing by the user.

Still another object of the invention is to provide a lighter with a novel and improved overall assembly and structural scheme wherein a simplified inner lighter assembly provides all of the conventional functions as well as a flint storage chamber with a novel retention structure to retain a flint in biased engagement with the friction wheel and to close the flint storage chamber.

Yet another object of the invention is to provide a novel and improved lid closure mechanism incorporating, in one embodiment, a novel leaf spring and tab biasing mechanism for positive closure of the lighter lid.

These and other objects of the invention will be more fully understood from a consideration of the following detailed description and the accompanying drawings, in which:

FIG. 1 is a side elevation of one conventional pipe lighter;

FIG. 2 is a side elevation of a lighter according to one preferred embodiment of the present invention;

FIG. 3 is a side elevation of the lighter of FIG. 2 from the reverse side thereof;

FIG. 4 is a top plan view of the flame shield of the lighter of FIGS. 2 and 3;

FIG. 5 is a sectional view taken on line V—V of FIG. 3;

FIG. 6 is a sectional view, which shows an alternative flame shield structure;

FIG. 7 depicts yet another alternative embodiment of the invention;

FIG. 8 depicts still another embodiment of the invention in sectioned side elevation;

FIG. 9 is a sectional view taken on line IX—IX of FIG. 8;

FIG. 10 is a fragmentary portion of FIG. 8 showing the lid of the illustrated lighter in an intermediate position.

Figure 11:
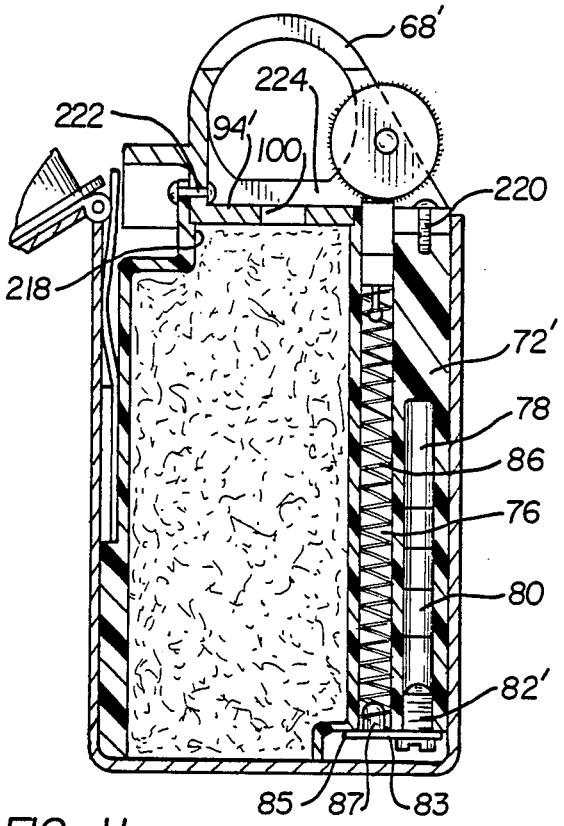
FIG. 11 is a sectioned side elevation similar to FIG. 8 showing other alternative structural features of the invention.

There is generally indicated at 10 in FIG. 1 a conventional pipe lighter having a flame shield 12 which incorporates a chimney in the form of a transverse through opening 14 for drawing the lighter flame into the bowl of a smoking pipe (not shown) to light the bowl contents.

The present invention is shown in FIGS. 2–5 as a lighter incorporating a novel and improved flame shield structure. More specifically, in FIGS. 2 and 3, a lighter generally indicated at 20 comprises a body 22 to which a cap 24 is hinged as at 26 and is adapted to cover a lighter head portion 28 which comprises a flame shield 30 that surrounds a lighter wick 32. Shield 30 carries a conventional friction wheel 36 which cooperates with a known flint (not shown) for striking a spark to ignite lighter fluid in wick 32 as is well known.

Flame shield 30 comprises a rigid body member 38, of cast and/or machined aluminum or steel, for example, or preferably of zinc alloy, and having a transverse through opening 40 and an elongated top opening 42. In addition to top opening 42, other passageways or openings may also provided to communicate between the exterior of shield 30 and the interior of transverse opening 40. For example, the friction wheel 36 is received within a slot 41 in a body member 38 and the clearance 34 around wheel 36 provides such a passageway. More significantly, a bore 44 extends transversely of opening 40 opposite the friction wheel 36 to provide another such passageway. Other such passageways may be located at various selected positions about the periphery of transverse through opening 40, for example as shown at **44*a* and 44*b* in FIG. 6**.

The transverse through opening 40 is defined by an open interior peripheral portion 46 of body 38 which preferably diverges from a relatively smaller cross-sectional area adjacent one outer end 48 of opening 40 to a relatively larger cross-sectional area adjacent the opposite outer end 50 of opening 40. The interior peripheral portion 46 may be of circular cross section as shown, tapering from a relatively smaller diameter adjacent outer end 48 to a larger diameter adjacent the opposite outer end 50 of through opening 40.

Furthermore, the outer end 48 of opening 40 may be of a cross-sectional area substantially equal to the area adjacent thereto of peripheral portion 46, and the opposite outer end 50 of opening 40 is of larger area than outer end 48, and may be comprised of a central opening 52 having an area substantially equal to that of outer end 48, and a plurality of smaller area opening 54 spaced circumferentially about opening 52.

The various elemental portions of through opening 40 as above described are arranged generally in mutually coaxial relationship to provide a downdraft chimney for lighting of a smoking pipe as follows.

In general, the outer ends 48, 50 of opening 40 define a flow restriction for air being drawn through opening 40, preferably by one of opening end portions 48, 50 being of larger effective flow area than the other. The open interior portion of body 38 need not necessarily diverge from open end 48 to open end 50 as shown in FIG. 5 so long as the opening end portions 48, 50 present flow area which result in a flow restriction of air flow therethrough. For example, the outer ends 48, 50may be different size circular openings in the side wall of a formed sheet metal flame shield structure which are differentially sized (a differential diameter of 0.02 inches for circular openings, for example) for effective drawing of air to light a pipe as below described.

Furthermore, it is to be noted that the invention contemplates an exended flat exterior surface area 49 surrounding at least the smaller of open ends 48, 50, such that substantially the entire top area of the pipe bowl may be covered by the flame shield and sealed against peripheral drafts as shown in FIG. 7 so that substantially all air drawn by the user during pipe lighting passes through the opening 40 and contributes to effective flame draw.

To light a smoking pipe, the user strikes a spark with friction wheel 36 as in conventional practice to ignite the flame 32. The lighter is then held sideways with the smaller outer end 48 of opening 40 adjacent to and generally in alignment with the bowl of a pipe as in FIG. 7 and with surface area 49 held closely adjacent to the open top of the pipe bowl and in overlying, covering relationship therewith. By drawing air via the pipe stem, the user creates a strong downdraft air flow via opening 40 which draws the lighter flame into the pipe bowl. As the downdraft air flow travels via opening 40 from the relatively larger area side 50 to the relatively reduced or restricted area side 48 the velocity of the air flow past wick 32 increases in accordance with the venturi effect to provide enhanced drawing capability. As a result, the lighter flame projects far into the pipe bowl for quicker and more efficient tobacco ignition. The venturi effect also provides for improved drawing of added air flow via such openings as bores **44, 44*a* 44*b*, and via the clearance 34 around friction wheel 36**.

In the embodiment of FIGS. 2–5, the openings 54 surrounding opening 52 not only serve to enlarge the effective cross-sectional area of outer end 50, they offer the additional advantage of a windbreaker effect, believed to be the resul of turbulence induced in the air flow, which reduces the incidence of flame blowout, even in the presence of the described higher velocity air flow through opening 40 and past wick 32.

The invention further contemplates the lighter shown in FIGS. 8, 9 and 10 as comprising a hollow case 60 having a main open-ended body portion 62 and a lid portion 64 which is affixed to body 62 by a hinge or pivot 66 to permit opening and closing of the lid 64 and thereby respectively reveal and conceal the lighter flame shield 68 and other operating components of the lighter which project out of body 62, as is well known. The flame shield 68 is but a portion of an inner lighter assembly 70 comprised of a body member 72 of, for example, molded and/or machined plastic, and which has defined therein a lighter fluid reservoir 74 which is filled with absorbent material to absorb and maintain a quantity of lighter fluid as is also well known.

Formed adjacent to reservoir 74 in body 72 in a pair of parallel bores 76, 78, which extend upwardly from the lower end of body 72. One of these bores, 75 for example, is a through bore which opens subjacent the location of a friction wheel 76 carried by flame shield 68, while the other bore 78 is preferably a blind bore of sufficient length and diameter to contain a plurality of spare flints 80. It is contemplated that bores 76 and 78 need not have a closed wall between them. That is, their diameters may overlap to a limited degree.

A screw 82 is threadedly received within the lower open end of bore 76 and includes a stud portion 84 which receives one end of an elongated coil spring 86 that extends within the bore 76. The opposite longitudinal end of spring 86 is similarly received and retained by a stud portion 88 of a flint engaging member 90. With screw 82 engaged within bore 76 as described, spring 86 is maintained in compression whereby a flint 80 located above member 90 is maintained in continuous biased engagement with friction wheel 75. As a substitute for the described screw arrangement, a similarly configured friction plug sometime may be employed to close bores 76 and 76.

Screw 82 includes an enlarged head portion 92 which is of sufficiently large diameter, given the proximity of bores 76 and 78, that the head portion 92 overlaps the perimeter of bore 78 and thereby serves as a closure to retain spare flints 80 therein. Screw 92 thus performs the dual function of maintaining one flint 80 in biased engagement with friction wheel 75 and retaining the spare flints 80 in place within the flint storage barrel formed by bore 78.

In FIG. 11 there is shown an alternative structure for retaining the flints within bores 76 and 78. Specifically, a screw 82' is threadedly engaged in, for example, bore 78 to retain spare flints 80 therein. A washer 83 is fitted onto screw 82' in the conventional manner and trapped between the same and the lower open end of bore 78. Washer 83 includes an enlarged or a generally laterally extending portion 85 on which there is carried an upwardly projecting stud 87 in a position for alignment thereof with bore 76 to receive and retain the lower end of spring 86 thereon. The washer 83 thus functions in substantially the same manner as the above-described enlarged head portion 92 of screw 82 to close the open end of the one of bores 76 and 78 within which the retention screw is not threadedly engaged.

Figure 12:
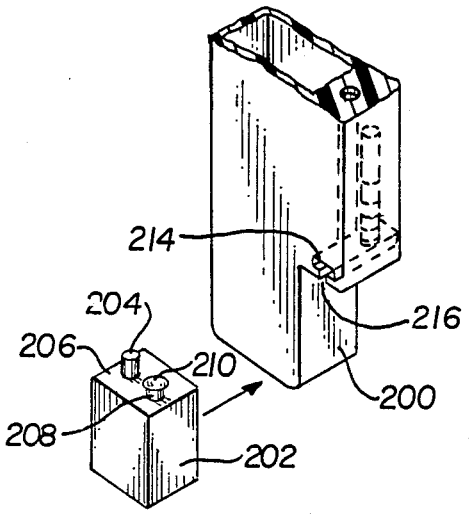
FIG. 12 is a partial perspective view of disassembled structural elements for another alternative embodiment for the flint storage and biasing aspect of the invention.
Figure 13:
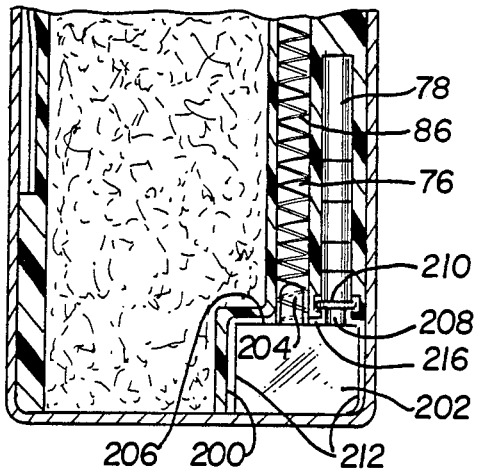
FIG. 13 is a fragmentary sectioned side elevation depecting the structural elements of FIG. 12 in their assembled configuration.

In still another embodiment, the structure for retaining the use and the spare flints is shown in FIGS. 12 and 13 as comprising an angular cutout 200 adjacent the lower open ends of bores 76 and 78. A closure block 202 is proportioned to fit within cutout 200 inside of lighter case 62 for retention thereof in closing relationship with the lower open ends of bores 76 and 78. Block 202 includes an upwardly projecting stud 204 on the top surface 206 thereof, and a second stud 208 having an enlarged head portion 210. In practice, the lower end of spring 86 is received on stud 204 and the stud 204 then placed within the lower end of bore 76. In this configuration, there is sufficient free play for block 202, as provided for example by clearances 212, to permit rotation of block 202 about the axis of bore 76 whereby stud 208 is free to pass into and out of the open ends 214 of a laterally extending T-slot 216 formed adjacent the lower end of bore 78. Of course, sufficient free play is provided for either or both of stud 204 in bore 76 or stud 208 in T-slot 216 to permit the above described rotation of block 202 to selectively release stud 208 from T-slot 216, or captively retain the stud 208 therein. Alternatively, T-slot 216 may extend on a radius reconned from the axis of bore 76 to accommodate such rotation of block 202.

In the position shown in FIG. 13, with the lighter body disposed within casing 62, the adjacent sidewalls of casing 62 prevent rotation of block 202. However, upon removal of the lighter body from case 62, the block 202 may be rotated to free stud 208 from T-slot 216 and thus permit removal of block 202 and consequent opening of both of bores 76 and 78, whereby a spare flint may be removed from bore 78 and placed above spring 86 in bore 76. The compression force of spring 86 normally exerts a downward bias on block 202, which is resisted by the engagement of stud 208 in T-slot 216. This takes up the described free play in the assembly of block 202 to the lighter body and thereby prevents the assembly from losening or inadvertently falling apart upon removal of the lighter body from case 62.

In a further embodiment of the invention as shown in FIG. 8, flame shield 68 is a preferably unitary structure comprising a pair of laterally spaced apart, upstanding sidewalls 92 (only one such sidewall portion being shown in FIG. 8) which are integral with both a base portion 94 and a transversely extending wind shield portion 96. The laterally spaced apart sidewall portions 92 include respective axially aligned through openings 98 which permit the lighter to be used in a horizontal orientation with flame shield 68 overlying the bowl of a pipe for pipe lighting. The openings 98 permit the lighter flame which is maintained intermediate sidewall portions 92 to be drawn downward into the pipe bowl by affording a venturi effect as air is drawn therethrough. The venturi effect is sufficient for the purpose even through the space between sidewalls 92 is substantially wider than the thickness of the sidewalls 92 themselves, and even though this intermediate area is open to the atmosphere throughout the top portion of flame shield 68 between wind shield 98 and friction wheel 75. As will be readily understood, the lighter flame is produced, as above described, by providing a wick which passes through aligned openings 100, 102 in base portion 94 and the upper end of body member 72 respectively. The wick draws lighter fluid from reservoir 74 which then is vaporized and may then be lighted by rotation of friction wheel 75 against flint 80 in the well known manner.

It will be noted that the openings 98 provide a transverse air flow path through flame shield 68 in one direction whereas wind shield portion 96 and friction wheel 75, which is located between sidewall portions 92, shield the flame from air currents in directions generally transverse to the axis of opening 98. Likewise, as noted, the upstanding sidewall portions 92 are laterally spaced apart and the space therebetween above flame shield 68 also is open whereby the flame projects upwardly when the lighter is held in an upright orientation for use thereof in lighting cigarettes and cigars.

It is reiterated that the upstanding sidewall portions 92 are of relatively thin section compared to the lateral separation between them. With this structure the flame shield 92 provides the described venturi function for enhanced pipe lighting capability without rendering the lighter in any way inconvenient for cigarette and cigar lighting.

Referring again to FIG. 11, another alternative embodiment for the lighter head structure is shown as a unitary flame shield 68' similar in many respects to the above-described flame shield 68, but having a thinner base portion 94' and a base structure which cooperates with a generally open top portion 218 of lighter body member 72' to facilitate securing the flame shield 68' with respect thereto. For example, flame shield 68' may be secured atop body member 72' by means of one or more threaded fasteners 220, or rivets 222, as shown in FIG. 11. It will of course be understood that the particular mode or means of attachment by which flame shield structure 68' is secured to lighter body 72' may be selected from a wide variety of options, and is not intended to limit the scope of the invention claimed. In particular, it is contemplated that the lighter head and body motions may be formed as a unitary structure, for example a cast metal structure.

The lighter structure according to the FIG. 11 embodiment does not contemplate the use of an elongated rivet passing through aperture 100 and an aligned aperture in the top of the lighter body. Accordingly, the need for an apertured top portion on lighter body member 72' is eliminated, and as a result the chimney effect exhibited by many conventional lighters is also eliminated. That is, in conventional lighters where a rivet extends vertically to join the lighter head to the lighter body, and the wick passes through a longitudinally extending bore formed in the rivet, the elongated proportions of the bore through which the wick extends creates an undesirable chimney effect resulting in an excessively high flame and undesirably high fuel consumption rates.

To further enhance the lighter of applicant's invention in this regard, the base portion 94' overlying the open top 218 of lighter body member 72' is of much thinner section than has been conventionally acceptable because, with no mechanical fasteners extending therein to secure the lighter head to the lighter body, structural strength of a magnitude to support such mechanical connection is not required for base portion 94'. Accordingly, the above-described chimney effect is reduced to a minimum, or effectively eliminated.

A further aspect of the invention shown in FIG. 11 is a wind guard or shield 224 formed adjacent the base 94' to form a protected well where the wick (not shown) projects upwardly from base 94'. The height of shield 224 is preferably in the range of 60 to 100 mils (thousands of an inch) and thus the shield 224 does not interfere with the above-described venturi function as provided by the disclosed flame shield structure; however, it does serve to reduce fuel consumption and further inhibit the described chimney effect by shielding the opening 100 from air currents which would otherwise promote a draft or chimney effect and in addition carry away fuel vapors before combustion thereof. The result is a lighter flame of more consistent height and blowout resistance and of greater efficiency in terms of fuel consumption.

The hinged lighter case lid 64 may be manually opened and closed substantially in the manner of prior known lighters; however, a novel spring bias mechanism is provided to incorporate an improved self-closing action. Specifically, an elongated leaf spring 104 (FIG. 8) is received within a cooperating groove 106 formed in body member 72 so as to extend upwardly into juxtaposition with hinge 66. Groove 106 preferably includes inwardly projecting flange portions 108 extending throughout a lower portion of its length to confine a respective lower portion 110 of spring 104, preferably with an interference fit. Accordingly, no adhesive or other mechanical fastening is required to retain spring 104 in place. As shown in FIG. 8, spring 104 is formed outward of lighter body 72 so that when the lighter assembly 70 is received within case 60, spring 104 is maintained in biased engagement with an inner portion of case 60 adjacent to hinge 66.

Lid 64 is provided with a projecting tab or cam 112 which is engageable with an upper end portion 114 of spring 104 as lid 64 is opened and closed to move spring 104 inwardly from its outwardly biased position as shown in FIG. 10. Specifically, as lid 64 is moved in the direction indicated by arrow A, the free end of tab 112 engages end portion 114 of spring 104 and pushes the same toward flame shield structure 68 as shown. At an intermediate point in the pivotal movement of lid 64, tab 112 reaches a "center" position with respect to its engagement of spring 104 such that upon further movement of lid 64 in the direction A, the bias of spring 114 will tend to bias lid 64 toward the closed position. With lid 64 fully closed, tab 112 is trapped against the interior of case 60 adjacent to hinge 66 by the outward bias of spring 114.

The lid closure mechanism thus provides a novel over-center actuator arrangement wherein spring 114 positively biases lid 64 toward either the fully open or the fully closed position thereof depending upon which side of center the tab 112 is with respect to engagement thereof upon spring 114. Most importantly, the outward bias of spring 114 positively maintains lid 64 closed even after extended use and considerable wear sustained by hinge 66. The result is a crisp, precise, snap action opening and closure of lid 64 which reflects an enhanced standard of mechanical integrity.

The novel elements of the lighter depicted by FIGS. 8 through 12, as above-described, offer a simplified and improved lighter structure which accords enhanced economy of manufacture and ease of assembly. The action of the spring biased lid closure mechanism as described results in reaction forces which tend to drive lighter assembly 70 downward into casing 60, rather than lifting the same out of casing 60 which, as above noted, has been a problem with conventional lighter lid closure mechanisms.

In view of the above description, it will be appreciated that the invention may be practiced in various other alternative and modified embodiments without departing from the broad spirit and scope thereof. For example, the size, number and spacing of openings 54 may be varied. The specific slope or rate of convergence of the interior periphery 46 of shield 30 may also be varied, or alternatively such convergence may be eliminated entirely as above noted. The inclusion of more or fewer passages such as 44, 44a, 44b as well as variation of their cross-sectional area is contemplated. Also, top opening 42 may be of any of a variety of geometric configurations consistent with its primary function of allowing the flame of the lighter, when upright, to project upwardly of shield 30 for convenient and effective cigarette lighting. Still further, the open ends 48, 50 may be of a variety of geometric configurations other than circular, consistent with the requirements of the invention as above described. Additionally, the lighter 20 may be of the type which burns gaseous fuel (e.g. butane) from an orifice in lieu of a liquid fuel burning lighter. Other modifications to other described embodiments also contemplated.

These and other embodiments and modifications having been envisioned and anticipated, it is intended that the invention be construed as broadly as permitted by the scope of the claims appended hereto.

I claim:

1. A hand-held smoker's lighter for igniting smoking instrumentalities comprising:

a lighter body having defined therein a fuel reservoir;

means for conducting fuel from said reservoir to a flame location for combustion thereof;

spark striking means carried by said body member in a position to permit sparks struck thereby to ignite lighter fuel and provide a flame at said flame location;

a flame shield comprising a formed body member having an open interior portion which generally encompasses said flame location and is open to the exterior of said flame shield, and a transverse through opening which traverses said open interior portion;

said transverse through opening having respective opposed open ends which are spaced apart generally in opposite directions from said flame location and an intermediate portion which extends intermediate said open ends and traverses said flame location and being operable as a venturi throat with air flow passing therethrough;

at least one passageway means extending transversely of said through opening to communicate between said open interior portion and the exterior of said body member; and said at least one passageway means including a top opening formed in an upper portion of said body member upwardly adjacent said flame location and being of a size to permit the lighter flame to project upwardly thereof for lighting a first selected type of smoking instrumentality.

2. The lighter as claimed in claim 1 wherein said flame shield includes an enlarged, generally flat external surface area encompassing at least one of said open ends such that said lighter may be positioned for lighting a smoking pipe with said flat surface area in closely adjacent covering relationship with an open pipe bowl to permit lighting thereof by the drawing of air via said transverse through opening to thereby draw the lighter flame into the pipe bowl.

3. The lighter as claimed in claim 1 wherein said open ends comprise a relatively larger flow area open end adjacent one lateral side of said flame shield and a relatively smaller flow area open end adjacent the opposed lateral side portion of said flame shield.

4. The lighter as claimed in claim 1 wherein said intermediate portion includes converging side wall portions of said open interior portion which converge from said larger flow area open end toward said smaller flow area open end.

5. The lighter as claimed in claim 1 wherein said open ends include barrier means which shield the base of the lighter flame from air currents passing through said transverse through opening by forming a shielded fuel vapor well within said transverse through opening.

6. The lighter as claimed in claim 5 wherein said means for conducting fuel from said reservoir to said flame location passes the fuel through said fuel vapor well.

7. The lighter as claimed in claim 6 wherein said fuel vapor well is located adjacent a peripheral portion of said transverse through opening and said means for conducting fuel includes a wick which pases from said peripheral portion to said flame location within said transverse through opening.

8. In a lighter for lighting smoker's instrumentalities, an inner lighter assembly which carries thereon a lighter head including a friction means and a flame shield, and which is adapted to be received within the confines of a lighter case, comprising:

a formed body member having an exterior form to permit sliding retention thereof within such a lighter case;

said body member having a hollow interior space formed therein to receive absorbent material whereby said hollow interior space provides a lighter fluid reservoir;

a through opening extending within said body member and having the opposed open ends thereof located adjacent the respective opposite ends of said body member and proportioned to receive a lighter flint slidably therein;

spring bias means received within said through opening for biasing such a lighter flint toward one of said open ends and into biased engagement with such a friction means;

an elongated flint storage barrel formed within said body member for storing spare flints therein, said flint storage barrel including an access opening located adjacent the said open end opposing said one open end; and a retention means cooperable with said access opening and said open end adjacent thereto to retain said spring bias means within said through opening and to close said access opening to thereby maintain such a flint in biased engagement with such a friction means and to retain such spare flints within said flint storage barrel.

9. The assembly as claimed in claim 8 wherein said retention means includes a threaded fastener which is received in one of said access opening or said adjacent open end and overlapping means cooperable with said threaded fastener to overlap at least a portion of said access opening and said adjacent open end when said threaded fastener is engaged within said body member.

10. The lighter assembly as claimed in claim 9 wherein said overlapping means is a head portion of said threaded fastener.

11. The lighter assembly as claimed in claim 9 wherein said overlapping means is a washer secured by said threaded fastener with respect to said body member.

12. The lighter assembly as claimed in claim 8 wherein said retention means includes a retention block having interlocked means and said body member includes cooperating engagement means for engagement by said interlock means to secure said block with respect to said body member in at least partial overlying relationship with both of said access opening and said adjacent open end.

13. The lighter assembly as claimed in claim 12 wherein said block additionally includes guide means cooperable with one of said access opening or said adjacent open end for guiding said block in pivotal movement between engaged and disengaged configurations of said interlock means with said engagement means.

14. The lighter assembly as claimed in claim 13 wherein said interlock means includes a stud having an enlarged head and said engagement means includes an open ended T-slot.

15. In a lighter for lighting smokers instrumentalities wherein an inner lighter assembly includes a lighter head portion that projects outwardly with respect to a case into which the inner lighter assembly is at least partially received, said lighter head portion comprising:

an outwardly projecting flame shield which defines an open interior space generally within the confines thereof;

a retention means for retaining an elongated flame propagating means within said open interior space such that the flame propagating means extends from a peripheral portion of said open interior space to deliver fuel thereinto for combustion of the fuel within said open interior space;

a transverse through opening having respective opposed open ends which are spaced apart generally in opposite directions from the location of the flame within said open interior space, and an intermediate portion which extends intermediate said open ends and transverses the location of said flame within said open interior space;

said transverse through opening being operable as a venturi throat when air currents are passing therethrough; and a shielded fuel vapor well located within said open interior space adjacent said peripheral portion thereof.

16. The lighter head portion as claimed in claim 15 additionally including transversely spaced shield means which extend into the respective said open ends of said through opening to form said fuel vapor well by shielding a portion of said transverse through opening adjacent said peripheral portion thereof from air currents passing through said transverse through opening.

17. The lighter head portion as claimed in claim 16 wherein said flame shield includes a pair of upstanding, laterally spaced apart sidewalls, each having one of said open ends formed therein.

18. The lighter head portion as claimed in claim 17 wherein said fuel vapor well is located transversely intermediate said upstanding sidewalls.

19. The lighter head portion as claimed in claim 17 wherein said shield means includes barrier means partially obstructing each of said open ends adjacent said peripheral portion.

20. The lighter head portion as claimed in 19 wherein said fuel vapor well is located adjacent a base portion of said lighter head portion which carries said upstanding side walls.

21. The lighter head portion as claimed in claim 20 wherein said open interior space is open to the exterior of the lighter head through said open ends and additionally through an opening formed intermediate said upstanding sidewalls and generally diametrically opposite said base portion, with respect to said transverse through opening.

* * * * *